United States Patent [19]

Qureshi

[11] 4,212,323

[45] Jul. 15, 1980

[54] POWER ASSIST PROPORTIONAL REMOTE CONTROLLER

[75] Inventor: Azam S. Qureshi, Racine, Wis.

[73] Assignee: Tomco, Inc., Racine, Wis.

[21] Appl. No.: 825,561

[22] Filed: Aug. 18, 1977

[51] Int. Cl.[2] ..... F15B 13/042

[52] U.S. Cl. ..... 137/625.61; 91/378; 137/625.64

[58] Field of Search ..... 91/378; 137/625.61, 137/625.62, 625.64

[56] References Cited

U.S. PATENT DOCUMENTS

| | | | |
|---|---|---|---|
| 2,931,343 | 4/1960 | Moog | 137/625.62 |
| 3,076,442 | 2/1963 | Raeber | 91/378 X |
| 3,486,801 | 12/1969 | Frayer | 137/625.64 X |
| 3,709,257 | 1/1973 | Faisandier | 137/625.64 |
| 3,805,670 | 4/1974 | Fallows | 91/378 |
| 3,875,849 | 4/1975 | Patel | 137/625.64 X |
| 4,014,509 | 3/1977 | Yoshino et al. | 137/625.64 X |
| 4,114,650 | 9/1978 | Gordon | 137/625.63 |

*Primary Examiner*—Gerald A. Michalsky
*Attorney, Agent, or Firm*—Ronald E. Barry

[57] ABSTRACT

A power assist remotely controlled servo controller for proportionally controlling the operation of a directional control valve, the controller including a servo-controlled force amplifying piston assembly to operate the directional control valve and a pilot pressure balanced piston connected to the servo-controlled piston assembly to control the directional control valve. The balanced pilot pressure forces acting on the pressure balanced piston being controlled by either a hydraulic or electric controller from a remote location.

7 Claims, 2 Drawing Figures

POWER ASSIST PROPORTIONAL REMOTE CONTROLLER

BACKGROUND OF THE INVENTION

The increase in the power requirement for hydraulically controlled mobile equipment requires a corresponding increase in the valve required to control the flow of hydraulic fluid to such equipment. The increase in size of the directional control valve makes the valve more difficult to control manually. Further, locating the control valve close to the actuator results in faster and more positive response, shorter high pressure lines requiring fewer connections, and enhanced operator safety since high pressure lines are no longer present in the operator station.

SUMMARY OF THE INVENTION

The power assist servo controller according to the present invention utilizes pilot pressure fluid to control a force amplifying piston assembly which is connected to the directional control valve. The pilot pressure control can be located at a remote operator's station thus allowing for either an electric or low pressure hydraulic line to control the force amplifying piston assembly which is mounted on the directional control valve.

DRAWINGS

DESCRIPTION OF THE INVENTION

Figure 1:
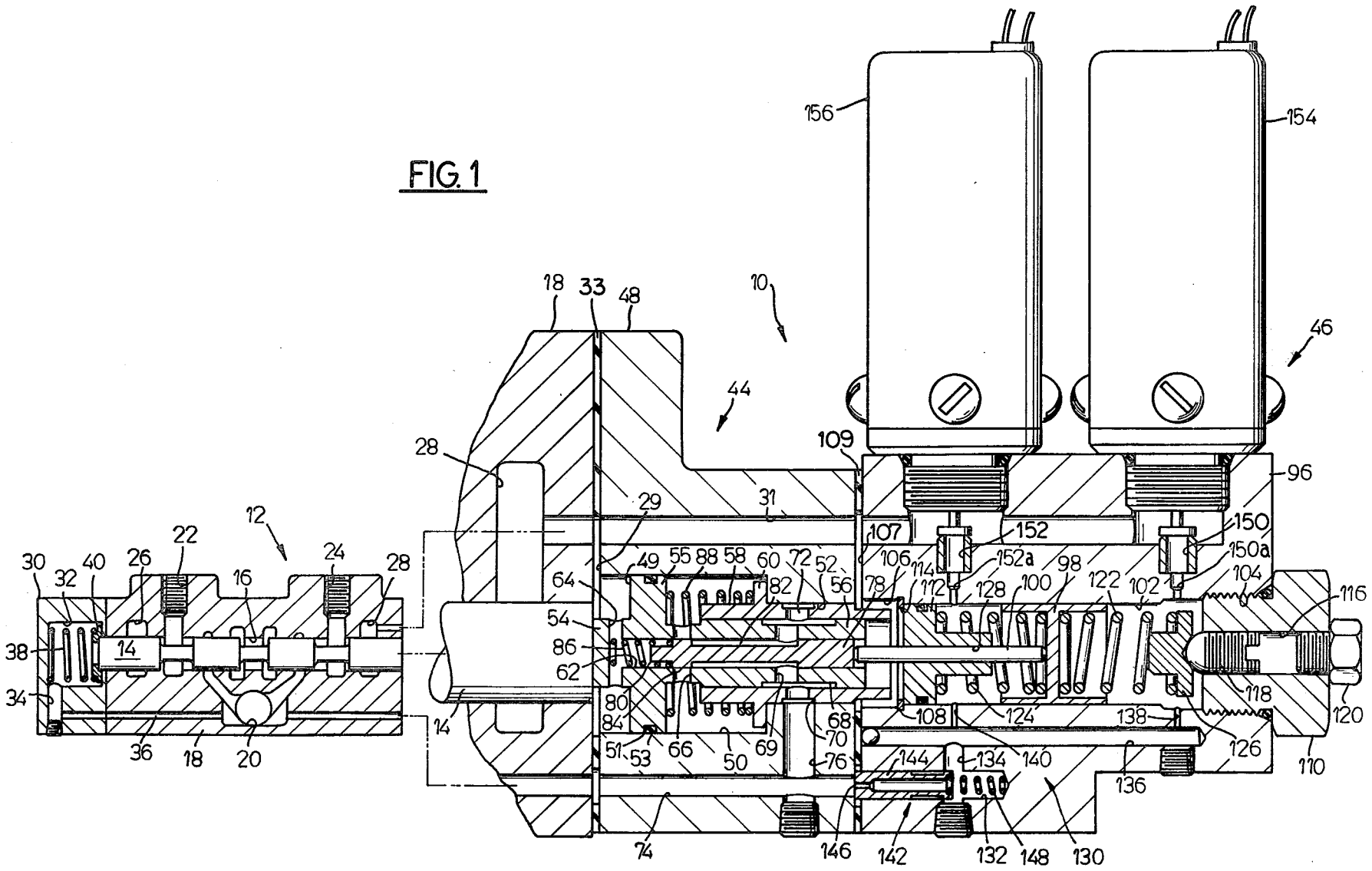
FIG. 1 is a sectional view of the power assist controller according to the present invention which is controlled by a pair of proportional solenoid valves.

The remote controlled power assist servo control 10 of the present invention is used to control a directional control valve 12. The directional control valve is of the conventional type having a valve spool 14 which is movable in a bore 16 in the valve housing 18 to control fluid flow from an inlet passage 20 to pressure passages 22, 24 and exhaust passages 26, 28. An end cap 30 is provided on the valve housing at one end of the valve spool 14 and includes a chamber 32 connected to the inlet pressure passage by passages 34, 36. The spool is biased to a neutral position within the valve housing by means of a main centering spring 38 which is seated on a spring retainer 40 that is seated on the end of the main spool 14.

Figure 2:
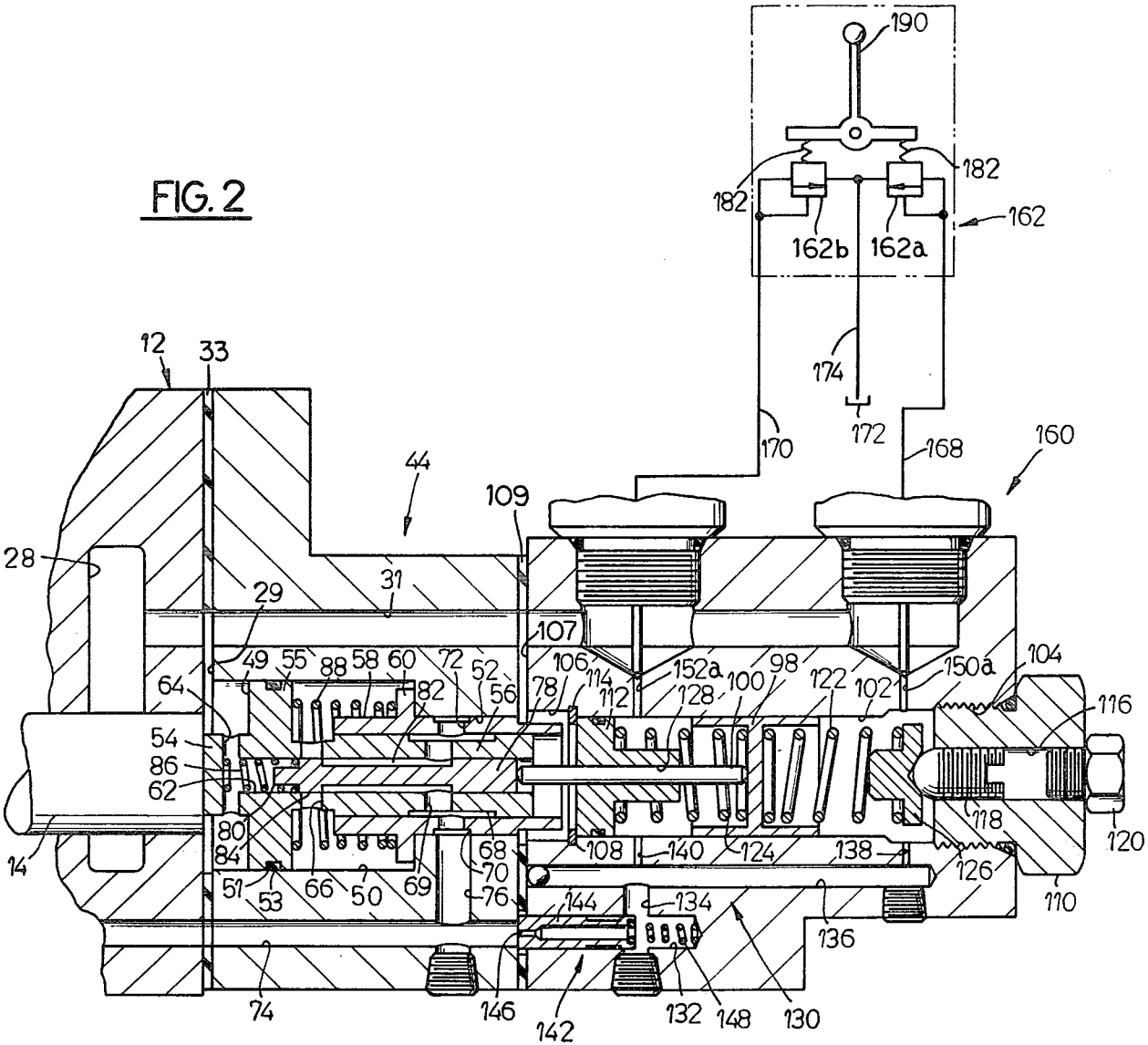
FIG. 2 is a sectional view of a power assist controller which is controlled by a hydraulic control valve.

In accordance with the invention, the remote controlled power assist servo control 10 is mounted on the valve housing 18 at the other end of the valve spool 14. The remote controlled servo control 10 generally includes a force amplifier 44 and a pilot operated remote controller 46. In this regard, the remote controller shown in FIG. 1 is electrically actuated. In FIG. 2, as described hereinafter, the remote controller is hydraulically actuated.

The force amplifier 44 includes a valve housing 48 having a control pressure chamber 50 adjacent the end of the valve spool 14 and a bore 52 connected to the opposite end of the chamber 50. The pressure chamber 50 is connected to the exhaust passage 28 by means of a flow passage 29 in the seal plate 33 and a passage 31.

The position of the valve spool 14 is controlled by means of a power piston 54 having a piston head 55 located in the chamber 50. The power piston includes an annular groove 49 at one end and a piston rod 56 which extends into the bore 52 at the other end. The piston head 55 is sealed in the chamber 50 by means of an O-ring seal 53 positioned in the annular groove 51 in the outer periphery of the piston head 55. The end of the power piston 54 is seated against the end of the valve spool 14.

An annular groove 68 is provided on the outer surface of the rod 56. An axial bore 62 is provided through a portion of the power piston 54. The bore 62 is connected to the pressure chamber 50 on one side of the piston head 55 by means of a first set of radial ports 64 and to the chamber 50 on the other side of the piston head 55 by means of a second set of radial ports 66. The bore 62 is connected to the groove 68 by means of a third set of ports 69. The piston rod 56 is supported in the bore 52 by means of a support member 58.

In this regard, the support member 58 is provided with a radial flange 60 and an annular groove 70, the radial flange 60 abutting against the end of the pressure chamber 50. The groove 70 is connected to the annular groove 68 in the piston rod 56 by means of a fourth set of ports 72, the annular groove 70 also being connected to the inlet fluid passage 20 by means of fluid passages 74 and 76.

The power piston 54 is biased to engage the end of the valve spool 14 by means of a spring 88.

The flow of fluid to the control pressure chamber 50 is controlled by means of a pilot spool 78 positioned within the bore 62 in the power piston rod 56. The pilot spool 78 is provided with an annular groove 80 at the inner end and an annular groove 82 which is spaced from the annular groove 80 to define a control land 84. As seen in FIG. 1, the control land 84 has a width equal to the diameter of the ports 66. The pilot spool is biased outwardly by means of a spring 86 provided between the end of the pilot spool 78 and the end of the bore 62. The power piston position is controlled by moving the pilot spool 78 relative to the ports 66 to either allow for the admission of inlet pressure fluid into the control chamber 50 or the exhaust of fluid from the control chamber 50 through the bore 62, ports 64, groove 49, port 29 and passage 31.

The force amplifier 44 is operated by means of the remote controller 46 which includes a housing 96 mounted on the housing 48 of the force amplifier 44. A pressure balanced pilot piston 98 is mounted within the housing 96 and is operatively connected to the pilot spool 78 by means of a pilot connecting rod 100. By controlling the pressure on either side of the pilot piston 98, the piston will move to the right or left moving the pilot spool 78 relative to the ports 66. As described above, movement of the pilot spool will allow for the admission of inlet pressure fluid or the exhaust of fluid from chamber 50. A drop in pressure in chamber 50 allows the valve spool 14 to move to the right due to the force inlet pressure fluid in chamber 32 acting on the end of the valve spool. An increase in pressure in chamber 50 will move the valve spool to the left in FIG. 1.

More particularly, the controller 46 includes a bore 102 having a threaded counterbore 104 at one end and a counterbore 106 at the other end which terminates at a groove 108. The counterbore 106 is connected to the exhaust passage 31 by means of flow passage 107 in seal plate 109. The bore 102 is closed at one end by means of a threaded end cap 110 and at the other end by means of a plug 112 which is retained in the bore 102 by means of a snap ring 114 positioned in the groove 108.

The end cap 110 includes a threaded bore 116. An adjustment screw 118 is provided at the inner end of bore 116. A threaded cap 120 is provided at the outer end of bore 116.

The pilot piston 98 is spring balanced to a neutral position in the bore 102 by means of springs 122 and 124. The spring 122 is positioned between the pilot piston 98 and a spring retainer 126 positioned on the end of the adjusting screw 118. The spring 124 is positioned between the plug 112 and the other side of the pilot piston 98.

The connecting rod 100 is supported in the bore 102 by means of the plug 112. In this regard, the plug 112 is provided with a bore 128 in which the connecting rod 100 is slidably positioned. The pilot spool 78 is biased by the spring 86 to follow the movement of the connecting rod 100.

Pilot pressure fluid is admitted into the bore 102 on each side of the pilot piston through a fluid passage network 130 which generally includes a blind bore 132, a connecting passage 134, a blind bore 136 and a pair of orifices 138 and 140. The bore 132 is connected to the inlet fluid passage 74 so that inlet fluid can flow through the network 130 into the bore 102.

The flow of inlet fluid into the pilot pressure network 130 is controlled by means of a pilot stage flow regulator 142 which includes a hollow sleeve 144 positioned in the blind bore 132. The sleeve 144 includes an inlet orifice 146. The sleeve 144 is free to move inwardly in the bore 132 and terminates short of the edge of the passage 134. The sleeve 144 is biased by means of a spring 148 outwardly into engagement with the valve housing 48. Inlet fluid passing through the orifice 146 normally flows through the sleeve 144, passage 134, bore 136 and orifices 138 and 140 into the bore 102.

In the event of a sudden drop in pressure in passage 134, the sleeve 144 will close passage 134 due to the force of the pressure of inlet fluid on the end of sleeve 144. The flow of fluid through orifice 146 will increase pressure in passage 132 moving sleeve 144 to the left to open passage 134. Thus the flow regulator 142 maintains a constant flow rate to the passage 134 regardless of changes in the inlet flow pressure or changes in pilot pressures in bore 102.

In order to actuate the pilot piston 98 to move the main spool 14, means are provided to restrict the flow of fluid flowing from bore 102 through intermediate orifices 150(*a*) and 152(*a*) to the outlet orifices 150, 152 which are connected to exhaust passage 31. Such means is in the form of a pair of proportional force solenoids 154, 156. The proportional force solenoids are conventional and assume predetermined positions depending on the current to the solenoid. Energizing one of the solenoids 154 or 156 results in the gradual closing of the corresponding orifice, increasing the resistance to fluid flow through the orifice 150 or 152, respectively, which in turn results in differential pressure build up across the piston 98. The piston 98 moves in proportion to the current energization of the solenoid. Since proportional force solenoids can be precisely controlled, they can (through the force amplifier 44) accurately control the movement of valve spool 14.

In operation, fluid is admitted to the inlet passages 74, 76 from the directional valve housing which pressurizes the entire system. As the fluid pressure increases in the chamber 32, the spool 14 will tend to move to the right. This tendency of the spool 14 to move the power piston 54 to the right in the chamber 50 will be balanced by the control pressure acting on the right side of power piston 54. If fluid under pressure is required for the pressure passage 24, the main spool 14 has to be moved to the left to connect the pressure passage 24 to the inlet fluid passage 20.

This is accomplished by energizing the proportional force solenoid 154 to close the orifice 150. This results in an increase in pressure in the bore 102 on the right side of the pilot piston 98, allowing the piston 98 to move to the left. The motion of the pilot piston 98 will be transmitted by the connecting rod 100 to the pilot spool 78 to open the port 66 allowing inlet fluid to enter chamber 50. The increase in pressure in the chamber 50 will move the power piston 54 to the left pushing the main spool 14 to the left.

The power piston will continue to move until port 66 is closed by land 84 on pilot spool 78. It should be noted that the pilot piston will assume a fixed position in bore 102 depending on the flow rate through orifice 150.

When solenoid 154 is deenergized, the orifice 150 will open, and pressures on both sides of piston 98 will equalize moving the pilot piston 98 to the neutral position. The pilot spool, power piston and main spool 14 will follow the pilot piston to the neutral position.

If the main spool 14 is to be moved to the right to connect the pressure passage 22 to the inlet fluid passage 20, the proportional force solenoid 156 is energized to close the orifice 152. Fluid in the bore 102 on the left side of the pilot piston 98 will increase in pressure, allowing the pilot piston 98 to move to the right. The pilot spool 78 and connecting rod 100 will follow the motion of the pilot piston 98 due to the bias of the spring 86. Movement of the pilot spool 78 will open the ports 66 allowing fluid in chamber 50 to flow through the port 66 into the bore 62 in the power piston 54 and out through the ports 64, groove 49 and port 29 into the exhaust passage 31. The drop in pressure in chamber 50 will allow the main spool 14 to move to the right due to the force of the inlet pressure fluid in chamber 32 acting on the end of the main spool 14. The power piston 54 will continue to move to the right until the land 84 on the pilot spool 14 closes the port 66. The main spool 14 will remain in this position as long as fluid is allowed to flow through the orifice 150 into the exhaust passage 31.

When the solenoid 156 is de-energized to open orifice 152, the pressures on both sides of piston 98 will equalize returning the pilot piston 98 to the neutral position. The movement of the pilot piston to the left in returning to the neutral position will move the pilot spool 78 to the left allowing inlet fluid to again enter the chamber 50 move the power piston to the left returning the main spool 14 to the neutral position.

In the embodiment of the invention shown in FIG. 2, a hydraulically controlled remote controller 160 is shown which is used to control the force amplifier 44 and the main spool 14 of the directional control valve 12. The force amplifier and directional control valve are identical to the force amplifier and directional control valve shown in FIG. 1 and are, therefore, numbered with the same numbers. The hydraulic remote control 160 is substantially identical to the electrically controlled remote controller 46 and where identical has been numbered with the corresponding numbers.

In the hydraulic controller 160, control of the flow of fluid through the orifices 150(*a*) and 152(*a*) is controlled by means of two manually adjustable hydraulic relief valves 162(*a*) and 162(*b*) located in the remote controller 162 shown schematically in FIG. 2. The bias forces of the springs 182 are controlled by means of a manual control handle 190 pivotally mounted on the remote controller housing. Pivotal movement of the handle 190 to the right or left in FIG. 2 will increase the bias force of one of the springs 182, resulting in a corresponding increase in pressure in lines 168 or 170. The increase in pressure differential across the piston 98 will allow the piston to move to the right or left. On release of the handle 190, the springs 182 will return the handle to neutral opening the line 168 or 170.

The embodiments of the invention in which an exclusive property or privilege is claimed are defined as follows:

1. A power assist remotely controlled servo controller for remote operation of a directional control valve, said directional control valve including a valve spool for directing inlet pressure fluid from an inlet passage to a pressure passage, a fluid pressure chamber in said directional control valve at one end of said valve spool, said pressure chamber being connected to the inlet pressure fluid passage, said servo control comprising:

force amplifying means mounted on said directional control valve, said amplifying means including a power piston operatively positioned to engage the other end of said valve spool, said amplifying means including first passage means connecting the inlet pressure fluid passage to said power piston and valve means in said power piston for controlling the flow of inlet pressure fluid to said amplifying means, and means for remotely controlling said valve means, said remote controlling means including a housing, a pressure balanced pilot piston positioned in said housing and operatively engaging said valve means, second passage means connecting the inlet pressure fluid passage to each side of said pressure balanced pilot piston, and selectively actuatable means for remotely releasing fluid pressure on either side of said pressure balanced piston whereby the movement of said pressure balanced piston is translated into movement of said valve means, said power piston following the movement of said valve means to control the position of the valve spool in the directional control valve.

2. The servo control according to claim 1 wherein said selectively actuatable means comprises an electrically controllable actuator.

3. The servo control according to claim 1 wherein said housing includes a pair of metering orifices located on opposite sides of said pressure balanced piston, said selectively actuatable means being connected to control said orifices.

4. The servo control according to claim 3 including means for manually adjusting the position of said pressure balancing piston.

5. The servo control according to claim 1 wherein said power piston includes a piston head, a piston rod, an axial bore and a first pair of ports connecting said bore to one side of said piston head and a second set of ports connecting said bore to the other side of the piston head, said valve means comprising a pilot valve positioned in said bore, said pilot valve including a land to control the flow of fluid through said second set of ports, said pilot valve in one position allowing for the flow of fluid to said other side of said piston head and in the other position allowing for the flow of fluid from said other side of said piston head to said first set of ports.

6. The servo control according to claim 5 wherein said housing includes a pair of metering orifices located on opposite sides of said pressure balanced piston, said selectively actuatable means being connected to control said orifices.

7. The servo control according to claim 6 wherein said selectively actuatable means includes a proportional force solenoid corresponding to each of said metering orifices.

* * * * *